US007203978B1

(12) United States Patent
Chang

(10) Patent No.: US 7,203,978 B1
(45) Date of Patent: Apr. 17, 2007

(54) SWIVEL HANDLE STRUCTURE FOR A BATHTUB

(76) Inventor: Shih-Kuo Chang, No. 71, Lane 54, Sec. 2, An Ho Rd., Tainan (TW)

( * ) Notice: Subject to any disclaimer, the term of this patent is extended or adjusted under 35 U.S.C. 154(b) by 0 days.

(21) Appl. No.: 11/420,716

(22) Filed: May 26, 2006

(51) Int. Cl.
*A47K 3/02* (2006.01)

(52) U.S. Cl. ..... 4/577.1; D23/303

(58) Field of Classification Search ..... 4/559, 4/571.1, 576.1, 577.1; D23/303, 304; 294/16, 294/103.1
See application file for complete search history.

(56) References Cited

U.S. PATENT DOCUMENTS 4,887,323 A * 12/1989 DiVito et al. ..... 4/577.1
5,659,904 A * 8/1997 Doczy et al. ..... 4/577.1
6,332,230 B1 * 12/2001 Chang ..... 4/577.1

* cited by examiner

*Primary Examiner*—Huyen Le
(74) *Attorney, Agent, or Firm*—WPAT, PC; Anthony King

(57) ABSTRACT

A swivel handle structure for a bathtub includes a holder, a handle seat and a press ring. The holder comprises a connecting plate having a number of locating holes and a recess thereon. The handle seat comprises a rotary disc having a circular rim inwardly corresponding to the recess of the connecting plate. The press ring is sleeved onto the handle seat. The press ring has a block rim to block the handle seat so as to confine the press ring from moving any further. When turning the handle seat, the circular rim of the rotary disc turns within the recess of the connecting plate so that the press ring maintains the handle seat in a steady manner from rocking or shaking.

7 Claims, 4 Drawing Sheets

SWIVEL HANDLE STRUCTURE FOR A BATHTUB

BACKGROUND OF THE INVENTION

1. Field of the Invention

The present invention relates to a swivel handle structure for a bathtub, in particular to a holder and a handle seat having a recess and a circular rim, respectively, to secure connection, and a press ring to restrain the handle seat in a steady movement when turning.

2. Description of the Prior Art

There are a few bathtubs designed for elderly users' safety, such as U.S. Pat. Nos. 4,254,516, and 6,332,230 B1, both of which are hereby incorporated by reference in their entirety. U.S. Pat. No. 6,332,230 B1 discloses a handle structure for a bathtub, which comprises a fixed board vertically disposed on a lateral side of a horizontal base body. The fixed board is adapted to contact an outer tub surface. A threaded rod is transversely disposed on the fixed board and includes a knob at an end thereof for rotating the threaded rod. A clip board is adapted to abut an inner tub surface. The clip board has a connecting rod transversally attached thereto for receiving the threaded rod. A rotary horizontal baseboard is pivotally coupled to the horizontal base body at a central pivot axis. A grab bar is vertically coupled to the baseboard. A tenon pipe is vertically disposed on the baseboard and radially spaced from the central pivot axis. An elastic bolt is disposed inside the tenon pipe. A number of insert holes are radially spaced about the central pivot axis on the horizontal base body. The elastic bolt is movable in the tenon pipe such that it is selectively engageable with any of the insert holes to adjust the angle of the grab bar with respect to the horizontal base body.

However, the connection between the clip board and the baseboard are depending on the pivot axis and the tenon pipe. The intensity is small, which causes the adjustment of the baseboard to shake and rock and may even cause detachment.

SUMMARY OF THE INVENTION

It is the primary objective of the present invention to provide a swivel handle structure for a bathtub, which is secure.

It is another objective of the present invention to provide a swivel handle structure for a bathtub, which is safe in use.

It is a further objective of the present invention to provide a swivel handle structure for a bathtub, which is stronger than the prior art.

According to the present invention, there is provided a swivel handle structure for a bathtub comprising a holder and a handle seat, said holder comprising a connecting plate, said connecting plate having a plurality of locating holes thereon, said handle seat comprising a rotary disc to be pivotally connected to said connecting plate of said holder, said rotary disc of said handle seat comprising a tenon pipe thereon, said tenon pipe comprising an elastic pin therein corresponding to a relative locating hole of said connecting plate, said elastic pin being to secure said rotary disc, said connecting plate comprising a recess corresponding to a circular rim of said rotary disc of said handle seat for connection purpose.

DETAILED DESCRIPTION OF THE PREFERRED EMBODIMENT

Figure 1:
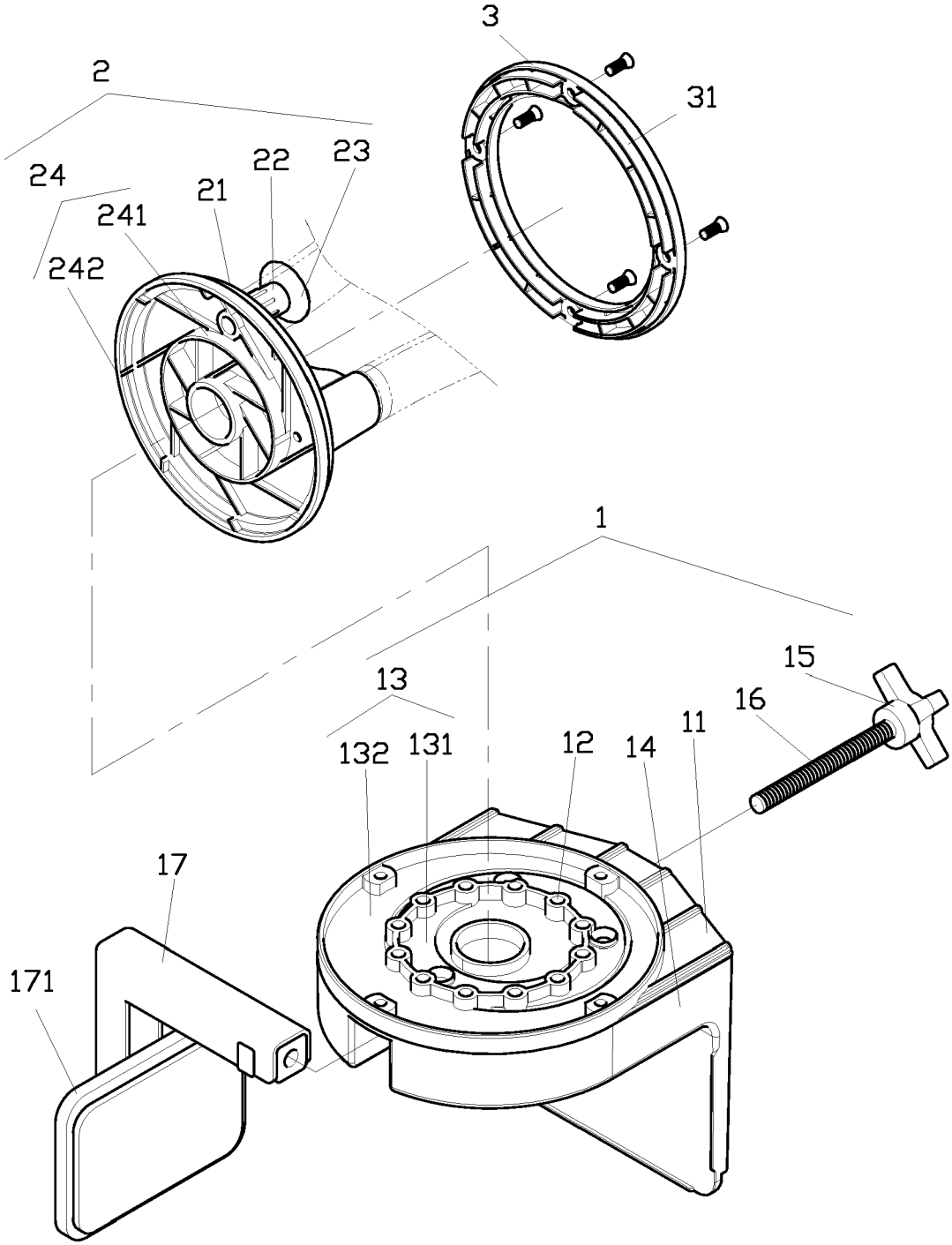
FIG. 1 is an exploded view of a preferred embodiment of the present invention.

As shown in FIG. 1, a preferred embodiment of the present invention comprises a holder 1, a handle seat 2, and a press ring 3.

The holder 1 comprises a connecting plate 11 thereof. The connecting board 11 comprises a number of locating holes 12 and a recess 13 thereon. The recess 13 comprises a first recess 131 and a second recess 132. The connecting plate 11 has a fixed board 14 vertically formed along one side thereof. A threaded rod 16 is transversely disposed on the fixed board 14. The threaded rod 16 is provided with a knob 15 and is connected to a clip board 171 having a linking rod 17 so that it can be secured to a bathtub.

The handle seat 2 comprises a rotary disc 21 having a tenon pipe 22 thereat. The tenon pipe 22 comprises an elastic pin 23 therein. The rotary disc 21 comprises a circular rim 24 inwardly. The circular rim 24 includes a first circular rim 241 and a second circular rim 242.

The press ring 3 is sleeved onto the handle seat 2 and comprises a block rim 31 thereof.

Figure 2:
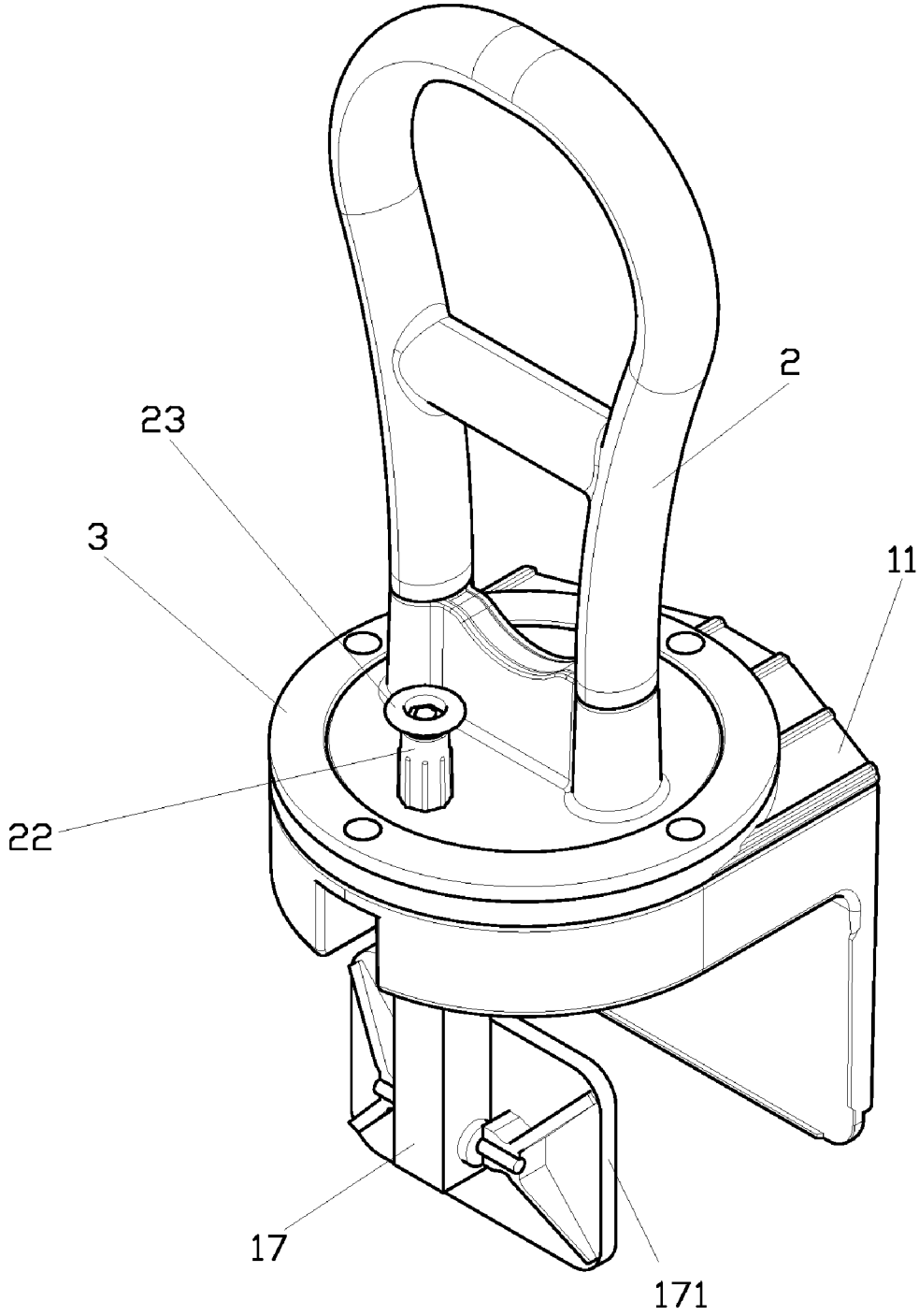
FIG. 2 is a perspective view of the preferred embodiment of the present invention
Figure 3:
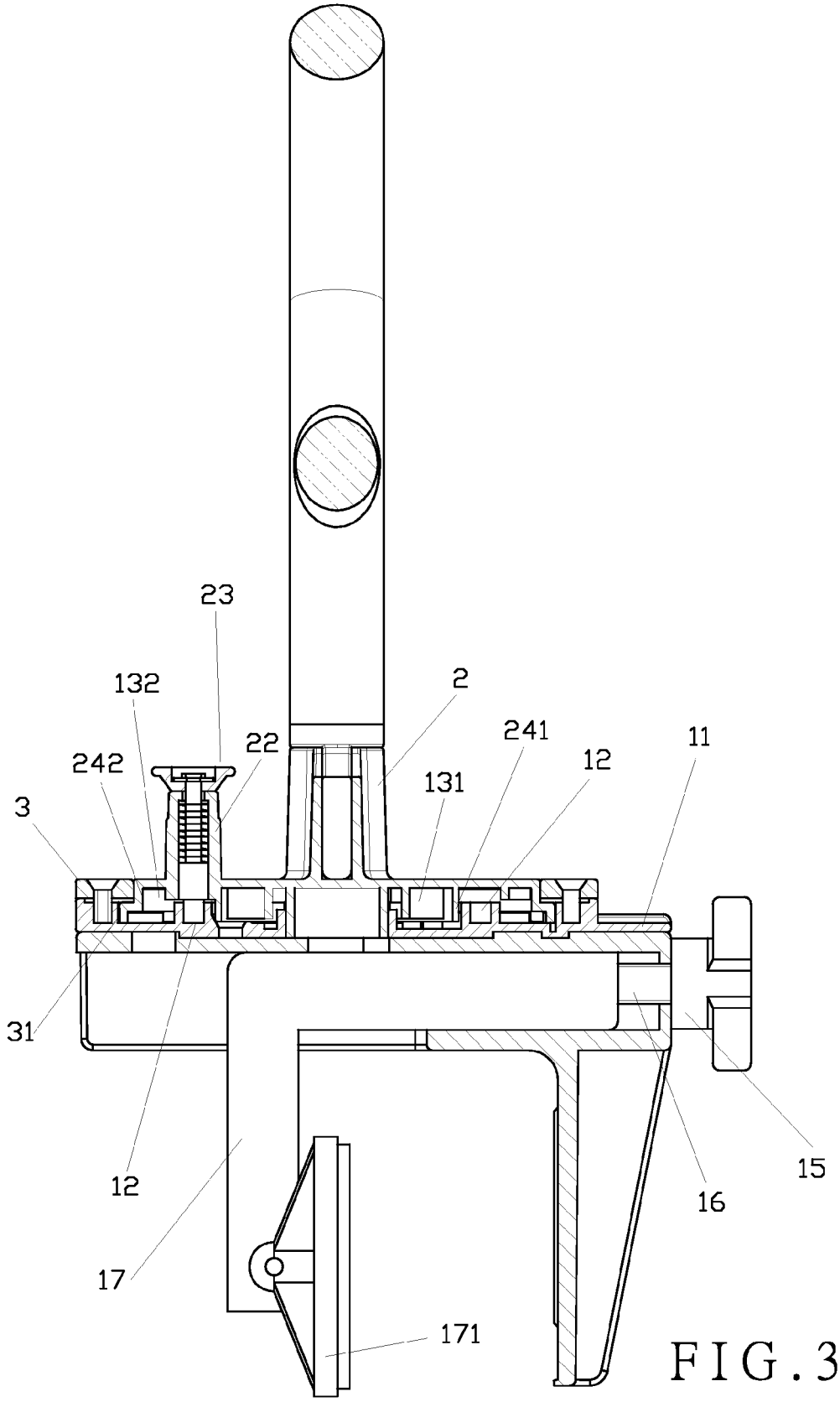
FIG. 3 is a side cross-sectional view of the preferred embodiment of the present invention.

To assemble the present invention, as shown in FIGS. 1, 2 and 3, the connecting plate 11 of the holder 1 is coupled with the handle seat 2. The press ring 3 is sleeved onto the handle seat 2. The block rim 31 of the press ring 3 blocks the handle seat 2. The first circular rim 241 and the second circular rim 242 correspond to the first recess 131 and the second recess 132, respectively. The connection of above will align the tenon pipe 22 of the handle seat 2 to a relative locating hole 12 of the connecting plate 11.

Figure 4:
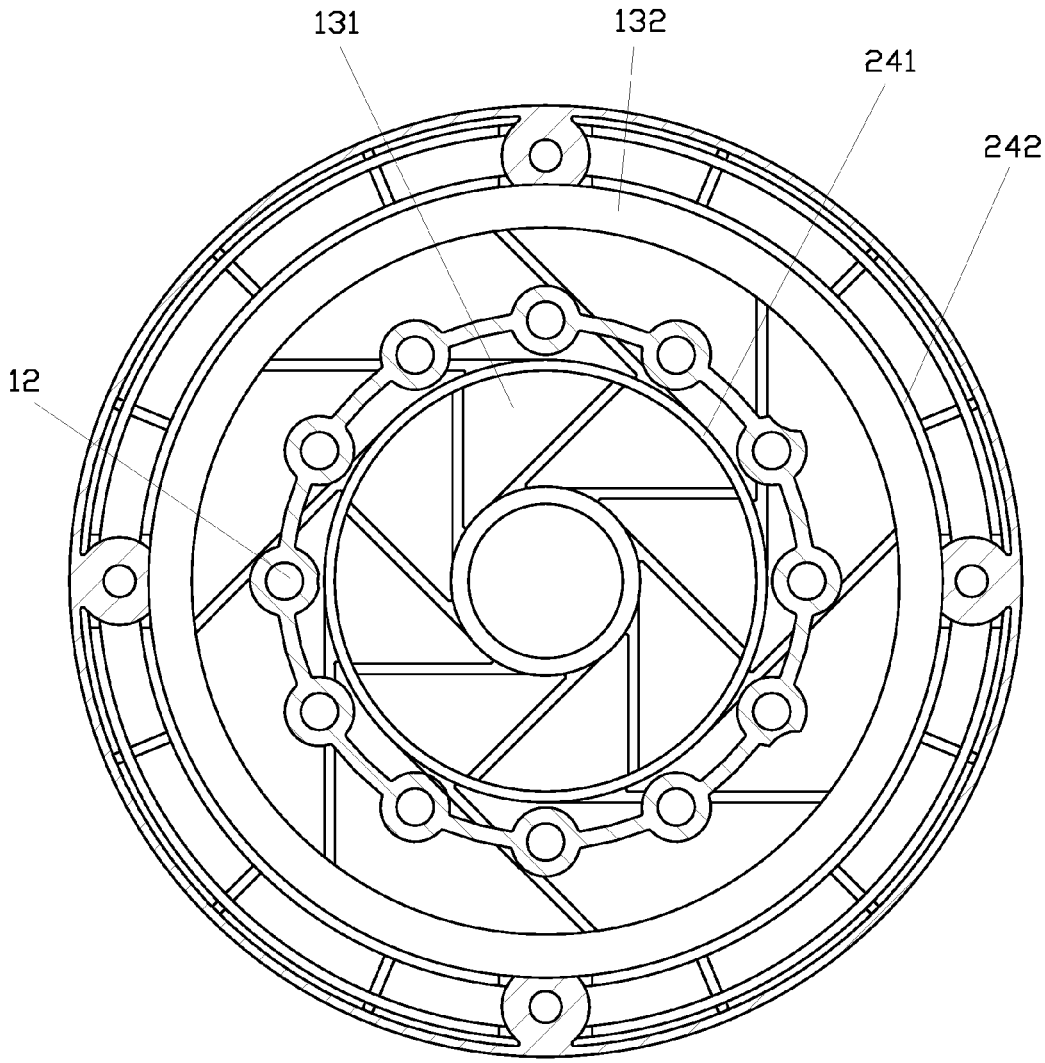
FIG. 4 is a top cross-sectional view of the preferred embodiment of the present invention in an operating status.

To operate the present invention, as shown in FIG. 4, when adjusting the handle seat 2 to a different angle, the elastic pin 23 is unplugged out of the tenon pipe 22, and the rotary disc 21 of the handle seat 2 is rotated. The first circular rim 241 and the second circular rim 242 engage with the first recess 131 and the second recess 132, respectively, which maintains the rotation in a steady manner. Upon the required angle is reached, the tenon pipe 22 is aligned with a relative locating hole 12 and the elastic pin 23 is inserted into the locating hole 12 to secure the handle seat 2.

Thus, specific embodiments and applications of swivel handle structure have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . . and N, the text should be interpreted as requiring only one element from the group, not A plus N, or B plus N, etc.

What is claimed is:

1. A swivel handle structure for a bathtub comprising a holder and a handle seat, said holder comprising a connecting plate, said connecting plate having a plurality of locating holes thereon, said handle seat comprising a rotary disc to be pivotally connected to said connecting plate of said holder, said rotary disc of said handle seat comprising a tenon pipe thereon, said tenon pipe comprising an elastic pin therein corresponding to a relative locating hole of said connecting plate, said elastic pin being to secure said rotary disc, and characterized in that:

said connecting plate comprising a recess corresponding to a circular rim of said rotary disc of said handle seat for connection purpose.

2. The swivel handle structure for a bathtub, as recited in claim 1, wherein said connecting plate comprises a first recess and a second recess.

3. The swivel handle structure for a bathtub, as recited in claim 1, wherein said rotary disc of said handle seat comprises a first circular rim and a second circular rim.

4. A swivel handle structure for a bathtub comprising a holder and a handle seat, said holder comprising a connecting plate, said connecting plate having a plurality of locating holes thereon, said handle seat comprising a rotary disc to be pivotally connected to said connecting plate of said holder, said rotary disc of said handle seat comprising a tenon pipe thereon, said tenon pipe comprising an elastic pin therein corresponding to a relative locating hole of said connecting plate, said elastic pin being to secure said rotary disc, and characterized in that:

the swivel handle structure further comprising a press ring, said connecting plate comprising a recess and said rotary disc of said handle seat comprising a circular rim corresponding to said recess of said connecting plate, said press ring being secured to said holder and restraining said handle seat.

5. The swivel handle structure for a bathtub, as recited in claim 4, wherein said press ring comprises a block rim to block said handle seat.

6. The swivel handle structure for a bathtub, as recited in claim 4, wherein said connecting plate comprises a first recess and a second recess.

7. The swivel handle structure for a bathtub, as recited in claim 4, wherein said rotary disc of said handle seat comprises a first circular rim and a second circular rim.

* * * * *